United States Patent [19]

Sasaki

[11] Patent Number: 4,550,585

[45] Date of Patent: Nov. 5, 1985

[54] DEVICE FOR HOLDING A WORKPIECE IN A PRESS

[76] Inventor: Naoyoshi Sasaki, 1067-2, Kami-Echi, Atsugi 243, Japan

[21] Appl. No.: 660,017

[22] Filed: Oct. 12, 1984

[51] Int. Cl.[4] ..... B21D 22/00

[52] U.S. Cl. ..... 72/351; 72/466

[58] Field of Search ..... 72/347, 348, 350, 351, 72/465, 466

[56] References Cited

U.S. PATENT DOCUMENTS

| | | | |
|---|---|---|---|
| 2,966,873 | 1/1961 | Hoffman | 72/466 |
| 3,296,850 | 1/1967 | Fiore | 72/351 |
| 4,211,102 | 7/1980 | Hurvitz | 72/351 |
| 4,316,379 | 2/1982 | Andersen | 72/466 |
| 4,483,170 | 11/1984 | Ogawa | 72/351 |

*Primary Examiner*—Leon Gilden

[57] ABSTRACT

A sheet metal working press including an upper press member and a lower press member which are movable relative to each other to work a sheet of metal therebetween. One of the press members has a groove formed in the vicinity of an effective working area defined by the movement of the press members toward each other. At least one holding block is loosely fitted in the groove. It has at least one holding surface and a plurality of holes formed in a surface remote from the holding surfaces. An elastic member of polyurethane is tightly fitted in each of those holes.

10 Claims, 8 Drawing Figures

DEVICE FOR HOLDING A WORKPIECE IN A PRESS

BACKGROUND OF THE INVENTION

1. Field of the Invention

This invention relates to a press for shaping a sheet of metal. More particularly, it relates to a device provided in a press for holding a sheet of metal in position.

2. Description of the Prior Art

It is very difficult to hold the edges of a sheet of metal properly between the upper and lower members of a press. If too strong a force is applied, the sheet is broken, and if the force is too small, it is deformed or curved.

Springs are often used to hold the sheet, but are unsuitable in case a strong elastic holding force is desired as a result of slight displacement, e.g. over a distance of about 1 or 2 mm. There is also known an arrangement employing rubber, but it is also unsuitable, since rubber is too soft.

According to another arrangement known in the art, one of the upper and lower members of a press has a bead surrounding the effective working area of the press, and the bead cooperates with a groove formed in the other press member to hold the metal sheet to be worked. The bead forms the sheet with a concavity extending along its peripheral edges and defining a relatively wide curved portion. This curved portion develops a frictional force which serves to hold the sheet in position. This curved portion has, however, to be removed from a final product. It is necessary to employ a relatively large sheet including an allowance for such a curved portion. A lot of material is wasted. A large space is required for storing not only the sheets to be worked, but also the scrap arising from the removal of the curved edge portions from the final products. These factors have hitherto hindered a reduction in the cost of production and an improvement in productivity.

SUMMARY OF THE INVENTION

It is a general object of this invention to provide an improved sheet metal working press which enables the effective and proper positioning of a sheet of metal without requiring any deformation of the sheet, and without causing the sheet to be damaged, wrinkled or otherwise deformed.

More specifically, it is an object of this invention to provide a device which can hold a sheet of metal in position in a press without deforming or damaging any portion of the sheet.

These objects are attained by a device comprising an upper or lower press member having a groove formed in the vicinity of an effective working area in a press, at least one holding block fitted loosely in the groove, having a holding surface projecting from the groove, and provided with a plurality of holes open in a block surface remote from the holding surface, and an elastic member of polyurethane fitted tightly in each of the holes of the block.

The device of this invention enables the manufacture of a product a flat or smooth or damage-free peripheral edge portion which is very suitable for any finishing work, such as spot welding. Insofar as it does not require any groove or other deformation to be made in the sheet to be worked, the device eliminates substantially any waste of material and enables the use of relatively small metal sheets which do not require any large space for storage. It, therefore, contributes to a reduction in the cost of the sheet metal working operation and an improvement in its efficiency. The device has a long life and contributes to improving the efficiency of the sheet metal working operation, since polyurethane is a material having a high degree of wear and oil resistance.

According to a preferred aspect of this invention, the device also includes a gap adjusting member disposed between each elastic member and the bottom of the groove, a cross shaft extending through the block in parallel to its holding surface to maintain the block in the groove, and a seat provided in the lower or upper press member and facing the holding surface of the block so that a sheet of metal may be held between the seat and the holding surface. The gap adjusting member enables the fine adjustment of the position of the holding surface so that it may project by a distance of about 1 or 2 mm from the surface of the press member in which the groove is formed, as long as the press is open. If the press is closed to work a sheet of metal, the polyurethane member imparts to the holding surface of the block a reasonably strong elastic force holding the sheet against the seat.

DETAILED DESCRIPTION OF THE INVENTION

Figure 1:
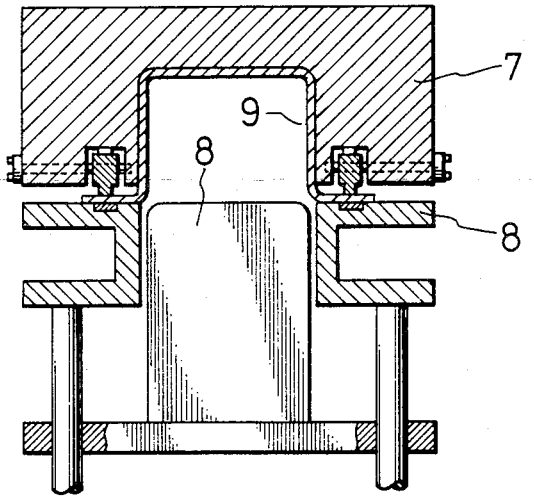
FIG. 1 is a vertical sectional view of a device embodying this invention.
Figure 2:
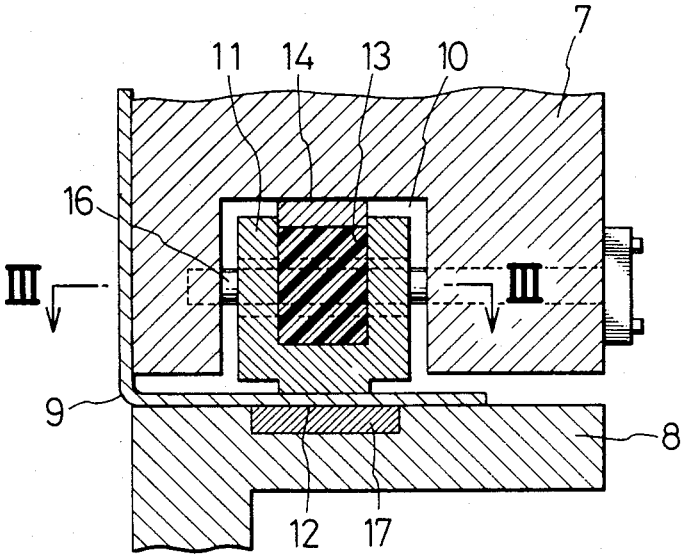
FIG. 2 is a fragmentary enlarged view of the device shown in FIG. 1 and a sectional view taken along the line II—II of FIG. 3.
Figure 3:
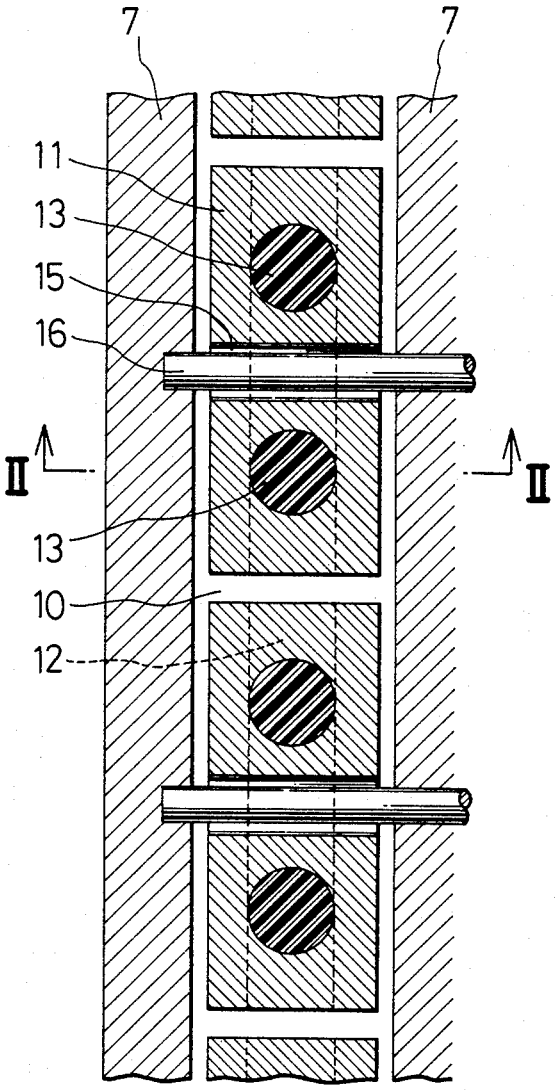
FIG. 3 is a sectional view taken along the line III—III of FIG. 2.
Figure 4A:
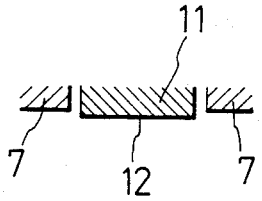
FIGS. 4A to 4C are fragmentary sectional views showing a number of holding block surfaces.
Figure 4B:
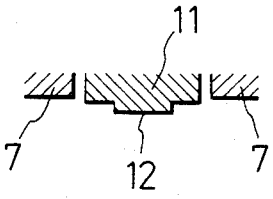
Figure 4C:
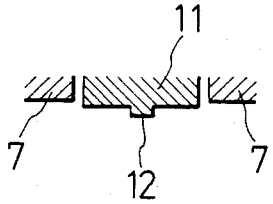

A press embodying this invention is shown in FIGS. 1 to 3 and comprises an upper press member 7 and a lower press member 8 between which a sheet 9 of metal to be worked will be positioned. The upper press member 7 has a groove 10 surrounding its central recess. A plurality of holding blocks 11 are loosely fitted in the groove 10. Each block 11 has an outer holding surface 12 which is engageable with the sheet 9. The holding surface 12 can be formed in various ways as shown by way of example in FIGS. 4A to 4C. The holding surface 12 shown in FIG. 4A coincides with the outer surface of the holding block 11. FIG. 4B shows a smaller holding surface 12 having a surface area which is equal to about a half of the area of the entire outer surface. FIG. 4C shows a still smaller or narrower holding surface 12. It will be noted that the smaller or narrower, the stronger and more concentrated force the holding surface 12 applies to the sheet 9.

Each holding block 11 has a plurality of holes formed in its inner surface remote from its holding surface 12. An elastic member 13 of polyurethane is tightly fitted in each hole. A gap adjusting member 14 is disposed between the elastic member 13 and the bottom of the groove 10. The gap adjusting member 14 may, for example, comprise a washer having an appropriate thickness. It is provided for effecting the fine adjustment of a distance by which the holding surface 12 projects downwardly from the lower surface of the upper press member 7.

FIG. 3 shows by way of example a pair of elastic members 13 for each holding block 11. Each holding block 11 has a transverse through hole 15, and a cross shaft 16 extends loosely through the hole 15. The shaft 16 has one end secured to the upper press member 7 and retains the block 11 within the groove 10. The lower press member 8 is provided with a plurality of seats 17 each facing one of the holding surfaces 12 so that the sheet 9 may be held between the holding surfaces 12 and the seats 17.

Figure 5:
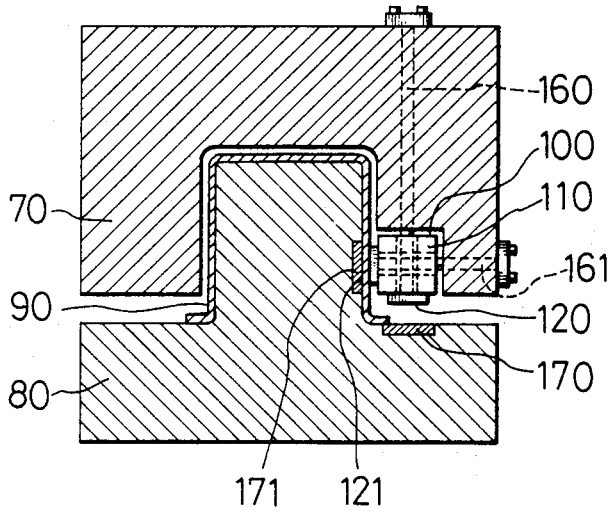
FIG. 5 is a vertical sectional view of a device according to another embodiment of this invention.

Referring now to FIG. 5 showing another embodiment of this invention, an upper press member 70 has a groove 100 formed at its inner edge and facing both its central working cavity and a lower press member 80. Each holding block 110 has a first holding surface 120 facing the lower press member 80 and a second holding surface 121 facing the working cavity of the upper press member 70. A vertical cross shaft 160 and a horizontal cross shaft 161 are provided for supporting the holding block 110. The lower press member 80 is provided with a first seat 170 facing the first holding surface 120 and a second seat 170 facing the second holding surface 121 when the press is closed, so that a sheet 90 of metal may be held between the holding surfaces 120 and 121 and the seats 170 and 171.

Figure 6:
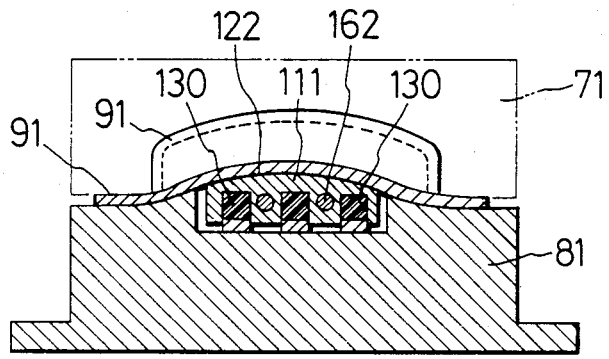
FIG. 6 is a vertical sectional view of a device according to still another embodiment of this invention.

Still another embodiment of this invention is shown in FIG. 6 and illustrative of an arrangement in which the various features of this invention are provided in a lower press member 81. FIG. 6 is illustrative of a holding block 111 having a curved holding surface 122. The holding block 111 is provided with three elastic members 130 and supported by a pair of cross shafts 162.

In operation, the gap adjusting member 14 is disposed between each holding block 11 and the groove 10 so that its holding surface 12 may project from the lower surface of the upper press member 7 by a distance of about 1 or 2 mm. A sheet 9 of metal is placed between the press members 7 and 8, and a load of, say, about two tons is applied to the press. The tightly fitted polyurethane members 13 impart to the holding surfaces 12 a reasonably strong elastic force by which the sheet 9 is properly held between the press members 7 and 8 without getting damaged or undesirably deformed. The operation and advantages of the modified arrangements shown in FIGS. 5 and 6 will be apparent from the drawings.

What is claimed is:

1. In a sheet metal working press including an upper press member and a lower press member which are movable relative to each other to work a sheet of metal therebetween, the improvement which comprises:

one of said press members having a groove formed in the vicinity of an effective working area defined by the movement of said press members relative to each other;

at least one holding block fitted loosely in said groove and having at least one holding surface, said block having a plurality of first holes formed in a surface remote from said holding surface; and an elastic member of polyurethane fitted tightly in each of said holes.

2. A press as set forth in claim 1, further including:

a gap adjusting member disposed between each of said elastic members and the bottom of said groove;

at least one shaft supporting said block in said groove; and a seat provided in the other of said press members and facing said holding surface.

3. A press as set forth in claim 2, wherein said groove is formed in said upper press member, and wherein said shaft is secured to said upper member and extends loosely through said block.

4. A press as set forth in claim 3, wherein said gap adjusting member comprises a washer.

5. A press as set forth in claim 4, wherein said upper press member has a central working cavity, while said lower press member has a central ram projection which is engageable in said cavity to work said sheet, and wherein said groove is spaced apart from said cavity and faces said lower press member outwardly of said ram projection.

6. A press as set forth in claim 4, wherein said upper press member has a central working cavity, while said lower press member has a central ram projection which is engageable in said cavity to work said sheet, and wherein said groove is located at the peripheral edge of said cavity and faces said cavity and said lower press member outwardly of said ram projection.

7. A press as set forth in claim 6, wherein said block is supported by two shafts crossing each other and has a pair of holding surfaces, one of said holding surfaces facing said seat, while the other holding surface faces said cavity and another seat provided in said ram projection upon movement of said press members relative to each other to close said press.

8. A press as set forth in claim 2, wherein said groove is formed in said lower press member, and wherein said shaft is secured to said lower press member and extends loosely through said block.

9. A press as set forth in claim 8, wherein said lower press member has a ram projection which is engageable in a working cavity in said upper press member, and wherein said groove is formed in said ram projection.

10. A press as set forth in claim 9, wherein said holding block has a curved holding surface.

* * * * *